US010989412B2

(12) United States Patent
Buse et al.

(10) Patent No.: US 10,989,412 B2
(45) Date of Patent: Apr. 27, 2021

(54) HEAT SHIELD ASSEMBLY OF A COMBUSTION CHAMBER HAVING A DISK SPRING SET

(71) Applicant: Siemens Aktiengesellschaft, Munich (DE)

(72) Inventors: Christoph Buse, Essen (DE); Andreas Böttcher, Mettmann (DE); Manfred Hartmann, Mülheim an der Ruhr (DE); Jens Kleinfeld, Mülheim an der Ruhr (DE); Andre Kluge, Dülmen (DE); Patrick Lapp, Berlin (DE); Thomas-Dieter Tenrahm, Dinslaken (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 89 days.

(21) Appl. No.: 16/085,164

(22) PCT Filed: Jun. 9, 2017

(86) PCT No.: PCT/EP2017/064069
§ 371 (c)(1),
(2) Date: Sep. 14, 2018

(87) PCT Pub. No.: WO2018/001696
PCT Pub. Date: Jan. 4, 2018

(65) Prior Publication Data

US 2019/0107286 A1 Apr. 11, 2019

(30) Foreign Application Priority Data

Jun. 28, 2016 (DE) ..... 102016211613.4

(51) Int. Cl.
*F23R 3/60* (2006.01)
*F23M 5/04* (2006.01)
*F23R 3/00* (2006.01)

(52) U.S. Cl.
CPC ..... *F23R 3/60* (2013.01); *F23M 5/04* (2013.01); *F23R 3/007* (2013.01);
(Continued)

(58) Field of Classification Search
CPC ..... F05D 2260/30; F05D 2260/31; F05D 2260/33; F05D 2260/38; F05D 2230/642;
(Continued)

(56) References Cited

U.S. PATENT DOCUMENTS 5,624,256 A 4/1997 Pfeiffer et al.
6,047,552 A 4/2000 Gross et al.
(Continued)

FOREIGN PATENT DOCUMENTS

CN 101922728 A 12/2010
CN 102460022 A 5/2012
(Continued)

OTHER PUBLICATIONS

International Search Report dated Aug. 25, 2017, for PCT/EP2017/064069.

*Primary Examiner* — Andrew H Nguyen
*Assistant Examiner* — Stephanie Cheng

(57) ABSTRACT

A heat shield assembly of a combustion chamber has a supporting structure and heat shield elements arranged on the supporting structure. For fastening, the supporting structure has spring devices fastened therein, into each of which a fastening bolt can be screwed. In order to realize the pre-installation and the later removal of the spring elements contained in the spring device, at a holding sleeve, a contact plate is removably fastened in the holding sleeve on the side
(Continued)

facing the heat shield element and a stationary securing plate is arranged on the opposite side.

13 Claims, 3 Drawing Sheets

(52) U.S. Cl.
CPC .... *F05D 2230/642* (2013.01); *F05D 2260/38* (2013.01); *F23M 2900/05002* (2013.01); *F23R 3/002* (2013.01); *F23R 2900/00005* (2013.01)

(58) Field of Classification Search
CPC ..... F05D 2240/15; F23R 3/60; F23R 3/007; F23R 3/002; F23R 2900/00017; F23R 2900/00005; F23M 2900/05002; F23M 2900/05004; F23M 5/04

See application file for complete search history.

(56) References Cited

U.S. PATENT DOCUMENTS

| | | | | |
|---|---|---|---|---|
| 6,341,485 | B1 | 1/2002 | Liebe | |
| 6,942,203 | B2 * | 9/2005 | Schroder | F01D 9/04 267/160 |
| 8,069,670 | B2 * | 12/2011 | Schmahl | F23M 5/04 60/753 |
| 2009/0205314 | A1 | 8/2009 | Schmahl et al. | |
| 2010/0307162 | A1 | 12/2010 | Bottcher et al. | |
| 2015/0285496 | A1 | 10/2015 | Grendel et al. | |

FOREIGN PATENT DOCUMENTS

| | | | |
|---|---|---|---|
| CN | 103930722 | A | 7/2014 |
| CN | 104718412 | A | 6/2015 |
| EP | 1533572 | A1 | 5/2005 |
| EP | 1533574 | A1 | 5/2005 |
| EP | 1862740 | B1 | 9/2015 |
| WO | 2010142510 | A1 | 12/2010 |
| WO | 2013068147 | A1 | 5/2013 |
| WO | 2015004642 | A1 | 1/2015 |

* cited by examiner

HEAT SHIELD ASSEMBLY OF A COMBUSTION CHAMBER HAVING A DISK SPRING SET

CROSS REFERENCE TO RELATED APPLICATIONS

This application is the US National Stage of International Application No. PCT/EP2017/064069 filed Jun. 9, 2017, and claims the benefit thereof. The International Application claims the benefit of German Application No. DE 102016211613.4 filed Jun. 28, 2016. All of the applications are incorporated by reference herein in their entirety.

FIELD OF INVENTION

The invention relates to a heat shield assembly of a combustion chamber of a gas turbine, wherein the combustion chamber has a support structure with heat shield elements mounted thereon. For the fastening of the heat shield element, a multiplicity of spring devices are provided in the support structure in this case for the elastic fastening of the heat shield elements.

BACKGROUND OF INVENTION

From the prior art, various solutions for the fastening of heat shield elements on a support structure of a combustion chamber are known. On account of occurring thermal expansions and vibrations it is absolutely necessary to provide an elastic fastening of the heat shield elements in the combustion chamber. To this end, various solutions are applied, wherein the heat shield elements are fastened either by means of an elastic clip or by means of a spring-mounted fastening bolt.

For the simple realization of a correspondingly elastic fastening of the fastening bolt, provision is made in the support structure of the combustion chamber at the individual fastening points in a known manner for spring packs which can be arranged on the support structure in a variety of ways. In the simplest way, a multiplicity of disk springs, and also a fastening nut, are arranged on the rear side pointing away from the combustion chamber interior. For accelerating the installation, it is also known to assemble the required disk springs to form a pack and in this case to arrange them in a sleeve. This sleeve is in turn fastened in the support structure. In a first known embodiment, use is made in this case of a sleeve, open toward the combustion chamber rear side, which comprises a multiplicity of disk springs and on the rear side has a pressure plate as the nut. This pressure plate is movable in the axial direction of the sleeve and is secured against loss by means of a locking element.

It has proved to be disadvantageous in the case of this solution that removal of the disk spring pack directly from the support structure is in many ways made difficult. A removal of the disk springs from the sleeve requires accessibility on the rear side of the support structure. This, however, depending on the position on the combustion chamber, is not provided. For solving this problem, EP 1 862 740 B1 discloses a disk spring pack in which a sleeve, which is open toward the combustion chamber interior, is used. In this case, a bottom of the sleeve which is arranged on the rear side forms the securing element against loss of the required pressure plate. The disk springs are similarly located on the pressure plate, wherein a disk with a supporting male thread is used as the abutment for the disk springs. In this case, the male thread is constructed in a manner to coincide with the male thread on the sleeve so that the sleeve and the disk can be screwed into a corresponding threaded hole in the support structure. As a result of this, removal of the disk spring pack toward the combustion chamber interior is subsequently enabled by unscrewing the disk, wherein the sleeve remains in the support structure.

In the embodiment with a sleeve open toward the rear side, there is the problem that the disk spring pack cannot be readily modified when required. In the alternative embodiment with the sleeve open toward the combustion chamber interior, there is the problem that this disk spring pack cannot be screwed directly into the support structure in a pre-assembled state.

SUMMARY OF INVENTION

It is therefore an object of the present invention to provide a fastening arrangement by means of which a simple fastening of the heat shield elements on the support structure can be carried out and, moreover, an exchange of the spring elements is possible when required.

The set object is achieved by means of an embodiment according to the invention. Another object is achieved by a spring device according to the invention as an essential component part of the heat shield assembly according to the invention. Advantageous embodiments are the subject matter of the dependent claims.

The heat shield assembly of a combustion chamber is considered in the present case, wherein the embodiments of the generic heat shield assembly are particularly suitable for use in a gas turbine. Required in this case are a support structure and a multiplicity of heat shield elements which are arranged on the support structure. In this case, the heat shield elements are installed on the side of the support structure pointing toward the combustion chamber interior. The type of fastening of the multiplicity of heat shield elements can be carried out in different ways. Generically, at least one heat shield element is installed on a spring device by means of a fastening bolt. To this end, the support structure has a through-hole in which the spring device is fastened. The type of fastening of the spring device in the through-hole of the support structure is initially unimportant in this case.

The generic spring device for use in the heat shield assembly has a receiving sleeve which is fastened in the support structure or can be fastened therein. Also required is an abutment plate, fixed relative to the receiving sleeve, which is arranged on the side of the spring device which points toward the receiving sleeve. Located on the opposite side, i.e. on a rear side of the spring device which points away from the heat shield, is a locking plate which is fixed relative to the receiving sleeve. In this respect, the receiving sleeve together with the abutment plate, and oppositely with the locking plate, form a locating space for the arranging of at least one spring element. Furthermore, a pressure plate which is axially movable in the direction of the center axis of the spring device is located between the abutment plate and the locking plate. The at least one spring element is in this case arranged between the pressure plate and the abutment plate. Naturally, it is also possible to arrange a multiplicity of spring elements between the abutment plate and the pressure plate. For using the spring device for fastening a heat shield element on the support structure, the abutment plate has a through-hole for receiving (inserting) a fastening bolt. Naturally, the through-hole is therefore at least slightly larger than the diameter of the fastening bolt. On the other hand, a fastening means for connecting the fastening bolt to the pressure plate is located in said pressure plate.

For forming a spring device, which can be both advantageously installed in the support structure in the pre-assembled state and also enable a subsequent exchange of the spring element, the abutment plate is fastened according to the invention in the receiving sleeve in a removable manner.

As a result of the arrangement according to the invention of the abutment plate in the receiving sleeve, a pre-assembly of the spring device for installing in the support structure is created. In contrast, in the case of the known prior art the abutment plate has to be installed in the support structure following the receiving sleeve so that a direct pre-assembly of the spring pack is not possible. Rather, the elements can be packed together loosely if need be. According to the invention, however, the spring device can now be pre-assembled in a pre-assembly so that a quick installation in the support structure at the installation site is enabled. Furthermore, the embodiment according to the invention enables a subsequent removal of the spring element so that the receiving sleeve can be removed in a similar way to the known embodiment.

How the fastening of the receiving sleeve in the support structure is carried out is initially unimportant, wherein this can be carried out for example by welding, soldering or adhesive fastening. It is also possible to use a bayonet connection for installing the spring device. For the reliable and at the same time simple fastening of the spring device in the support structure, especially with consideration of the occurring temperatures, it is particularly advantageous if the receiving sleeve has a male thread which is screwed into a female thread of the through-hole. For securing against a subsequent loosening during operation of the gas turbine it is possible to peen the thread from the combustion chamber inner side or from the rear side so that an inadvertent unscrewing is in effect prevented.

The embodiment of the locking plate is initially unimportant providing it is ensured that the locking plate prevents loss of the pressure plate in the pre-assembled state. In this respect, it is only necessary that the locking plate absorbs the spring forces which occur in the pre-assembled state. It is particularly advantageous in this case, however, if the locking plate is arranged integrally on the receiving sleeve. In this respect, the receiving sleeve together with the locking plate form a pot which is open toward the combustion chamber interior.

The locking plate serves only for securing the pressure plate inside the receiving sleeve. In this respect, this can have a varied design. It is particularly advantageous, however, if the locking plate has a through-hole in a similar way to the abutment plate. As a result of this, it is made possible that the fastening bolt, when being screwed into the spring device, can emerge from the spring device on the rear side and in this respect a sufficient installation space is provided for the screwing in.

How the abutment plate is constructed is initially unimportant providing, at least in the pre-assembled state of the spring device, the spring forces occurring in this case are absorbed. It is particularly advantageous, however, if it is ensured that when using the spring device and applying the increased spring forces in this case these spring forces can be transferred via the abutment plate and via the receiving sleeve to the support structure. With regard to this, it is unimportant if it is regularly provided that the heat shield element bears directly on the abutment plate and/or the receiving sleeve and in this respect some of the spring forces are transferred at least directly to the heat shield element.

For fastening the abutment plate in the receiving sleeve the abutment plate is particularly advantageously formed as an integral component part of an inner sleeve. As a result of this, for fastening the abutment plate in the receiving sleeve the inner sleeve is consequently fastened in the receiving sleeve in a removable manner.

In this case, the inner sleeve can be particularly advantageously designed in such a way that the spring element, or a plurality of spring elements when present, this/these can be arranged in the inner sleeve.

Furthermore, it is particularly advantageously provided that the pressure plate is also arranged, at least in certain sections, inside the inner sleeve at least in the state of the fastened heat shield elements.

For fastening the inner sleeve in the receiving sleeve various possibilities are made available. In a both simple and advantageous embodiment, the abutment plate, or in the case of an embodiment of the abutment plate as an integral component part of an inner sleeve, the inner sleeve is screwed in the receiving sleeve. Consequently, the abutment plate or the inner sleeve has a male thread and in contrast the receiving sleeve has a female thread.

Instead of using a threaded connection, it is also possible to provide a bayonet connection between the abutment plate or the inner sleeve and the receiving sleeve. When using a bayonet connection, it is advantageous to design the bayonet connection while taking into consideration the spring forces of the spring element in such a way that the abutment plate or the inner sleeve can be installed with a pressure plate bearing on the locking plate. As a result of the subsequently occurring increased spring forces when using the spring device, the bayonet connection is secured between the abutment plate or the inner sleeve and the receiving sleeve against an unwanted release.

In principle, it is advantageous if the upper side of the abutment plate which points toward the combustion chamber interior terminates flush with the receiving sleeve. Therefore, a flat upper side toward the heat shield element is formed. This facilitates the design and also the installation in the support structure.

Particularly advantageously provided when the heat shield element is being fastened on the support structure is an abutment of the heat shield element against an upper side of the receiving sleeve which points toward the combustion chamber interior and against an upper side of the abutment plate which correspondingly points toward the combustion chamber inner side. When using a screwed connection between the abutment plate or the inner sleeve and the receiving sleeve, the common abutment both against the abutment plate and of the receiving sleeve against the heat shield element particularly leads to the prevention of a relative loosening of the abutment plate relative to the receiving sleeve.

The fastening of the fastening bolt on the pressure plate for fastening the heat shield element on the support structure can also be carried out in a variety of ways, wherein for example a bayonet connection can be used. In a both simple and also advantageous manner the fastening bolt is fastened in the pressure plate by means of a thread. Correspondingly, the fastening bolt is represented as a screw and the pressure plate as a nut.

For preventing a co-rotation of the pressure plate when attaching the fastening bolt, it is advantageous if the rotation around the longitudinal axis of the spring device is prevented by means of at least one guide flange which is provided on the pressure plate, wherein the guide flange is guided in a guide groove. In this case, it can be provided that provision is made in the inner sleeve for an inner guide groove in which the guide flange is guided. Alternatively or additionally, it can also be provided that provision is made in the receiving sleeve for an outer guide groove. It is obvious that in principle the use of a single guide flange is sufficient, but particularly for preventing tilting the use of two or a multiplicity of guide flanges and corresponding guide grooves constitutes an advantage. Furthermore, it is obvious that the arrangement can be reversed so that a guide flange is arranged on the inner sleeve and/or on the receiving sleeve and corresponding to this the pressure plate has a guide groove.

A particularly advantageous method for preventing loosening or a relative movement of the inner sleeve relative to the receiving sleeve—regardless of the use of a bayonet connection or a screwed solution—is created if the pressure plate is guided by means of a guide flange both on the receiving sleeve and on the inner sleeve, but in this case the guiding on the inner sleeve becomes effective only during the fastening of a fastening bolt and drawing up of the pressure plate onto the abutment plate. To this end, it is provided that the inner sleeve is designed to be shorter, at least by the thickness of the pressure plate, than the depth of the receiving sleeve allows. In this respect, when the pressure plate bears on the locking plate a free rotation of the inner sleeve relative to the receiving sleeve is enabled. If now, however, the pressure plate, for example during the fastening of a heat shield element, is displaced against the spring force in the direction of the abutment plate, the engagement of the guide flange is carried out in addition to the guiding on an outer guide groove of the receiving sleeve and also subsequently an engagement in an inner guide groove of the inner sleeve. As a result of this, not only a co-rotation of the pressure plate is prevented but also a relative rotation of the inner sleeve relative to the receiving sleeve.

An essential component part of the heat shield assembly according to the invention is a new type of spring device according to the invention, as previously described. This especially enables use in a combustion chamber of a gas turbine, in which operationally induced high thermal expansions occur and a reliable fastening in the case of vibrations also has to be ensured.

The heat shield assembly according to the invention also enables the realization of a combustion chamber according to the invention by using a corresponding heat shield assembly having a spring device according to the invention.

Furthermore, this consequently leads to a new type of gas turbine according to the invention by using a combustion chamber correspondingly according to the invention.

BRIEF DESCRIPTION OF THE DRAWINGS

In the following figures, an example of a heat shield assembly according to the invention and also two examples of spring devices according to the invention are outlined in detail. In the drawing.

DETAILED DESCRIPTION OF INVENTION

Figure 1:
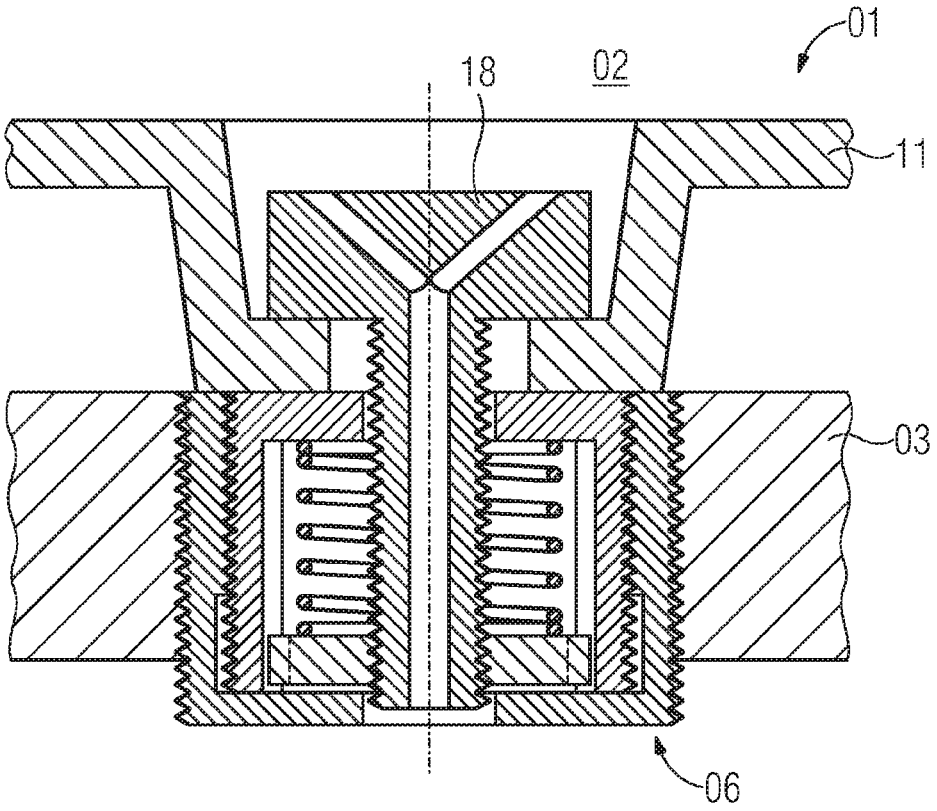
FIG. 1 shows a section of the exemplary heat shield assembly in the region of the spring device.
Figure 2:
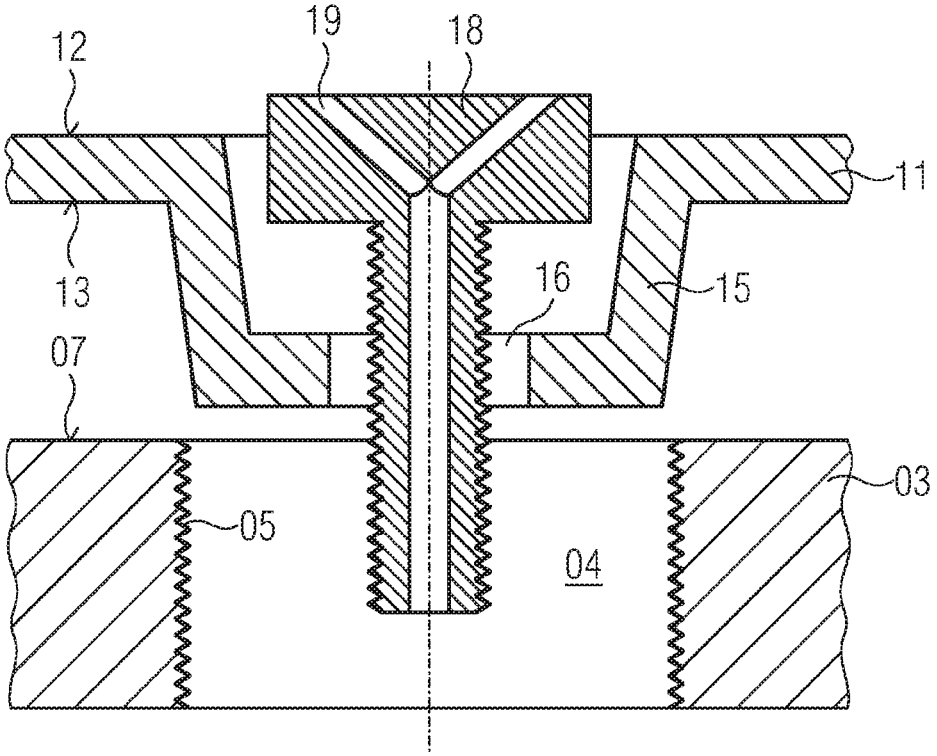
FIG. 2 shows a view in relation to FIG. 1 with the spring device omitted.

FIG. 1 shows only a small detail of an exemplary heat shield assembly 01 in the region of an exemplary spring device 06 according to the invention. To this end, FIG. 2 again outlines the elements of the heat shield assembly 01, omitting the spring device 06. Apparent first of all is the support structure 03, in which is located a receiving hole 04, wherein in this case the receiving hole 04 is a through-hole with a female thread 05. Arranged on the upper side 07 which points toward the combustion chamber interior 02 is a heat shield element 11 which is fastened by means of a fastening bolt 18 on the spring device 06 and therefore on the support structure 03. To this end, the heat shield element has a fastening base 15 in which is located a through-hole 16 for receiving the fastening bolt 18.

The heat shield element 11 in this case has a hot side 12 which points toward the combustion chamber interior and a cold side 13 which points toward the support structure 03. Outlined in this exemplary embodiment is a metal heat shield element 11 which has a fastening base 15 which extends from the cold side 13 to the upper side 07 of the support structure 03. It is provided in this case that the fastening base 15 bears on the spring device 06. With regard to the embodiment according to the invention, it is unimportant in this case how the heat shield element 11 is subsequently designed and in this respect whether the heat shield element 11 has an encompassing edge which extends from the cold side 13 to the support structure 03, which edge can be formed with a gap toward the upper side of the support structure 03 or selectively comes to lie on the support structure 03.

For cooling the fastening bolt 18, this has a cooling passage 19 which extends from the rear side to the combustion chamber interior. As a result of this, the effect of the fastening bolt 18 becoming prematurely fatigued on account of high thermal load is prevented.

Figure 3:
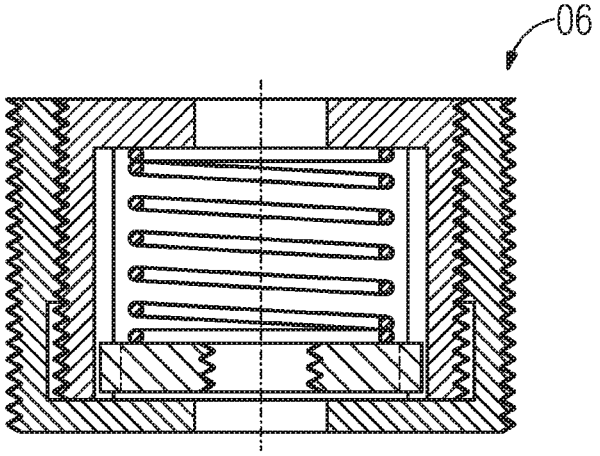
FIG. 3 shows the spring device in relation to FIG. 1.
Figure 4:
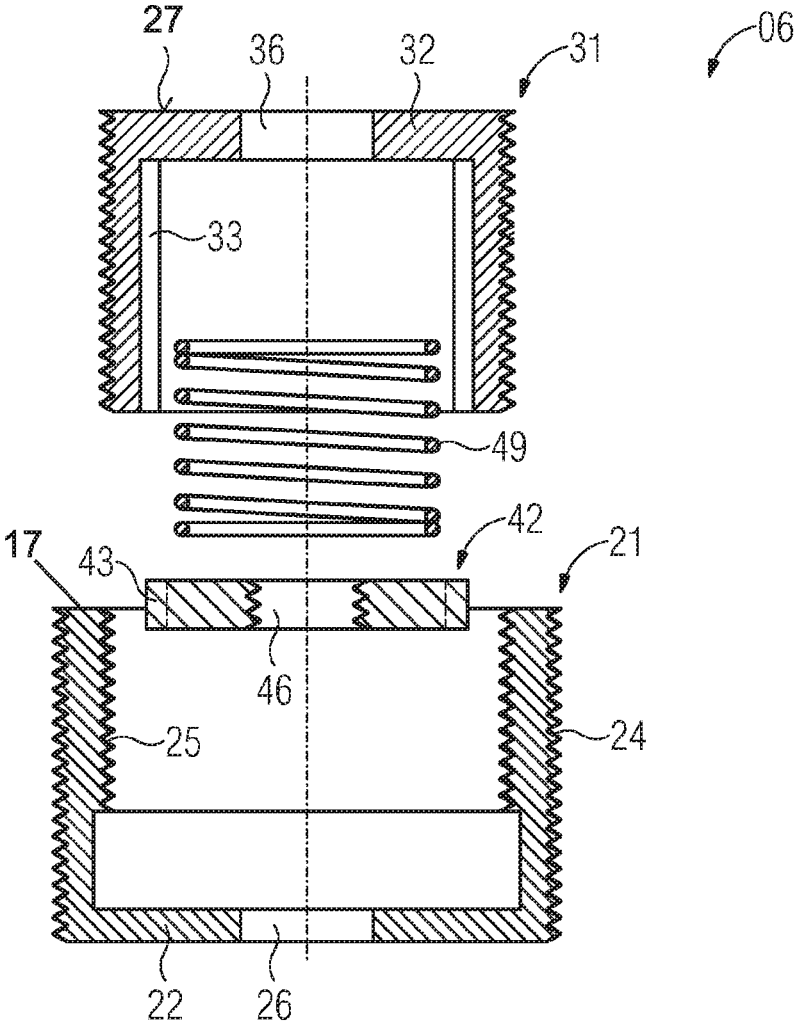
FIG. 4 shows an exploded view in relation to FIG. 3.

The spring device 06, as outlined in FIGS. 3 and 4, has a receiving sleeve 21 which in this case is constructed with a male thread 24 for screwing into the receiving hole 04 of the support structure 03. The receiving sleeve 21, on the rear side pointing away from the heat shield element 11, integrally forms the locking plate 22 so that the receiving sleeve 21 is represented in the style of a pot which is open toward the heat shield element 11. For enabling screwing in of the fastening bolt 18, the locking plate 22 is also provided with a through-hole 26. For the fastening of the abutment plate 32 or the inner sleeve 31, it is provided that the receiving sleeve 21 also has a female thread 25 on the inner side. The inner sleeve 31 is correspondingly screwed in the receiving sleeve 21, wherein it is provided in this exemplary embodiment that the upper side 17 of the receiving sleeve 21 terminates flush with the upper side 27 of the inner sleeve 31.

The inner sleeve 31 integrally forms the abutment plate 32, wherein the abutment plate 32 also features the through-hole 36 for receiving the fastening bolt 18. On the inside, the inner sleeve 31 has guide groves 33 which extend in the axial direction of the spring device 06. The spring element 49 for realizing the spring device is formed by way of example in this exemplary embodiment by a compression spring 49. It is obvious that a disk spring pack can also be used in dependence of the required spring forces.

Located between the spring element 49 and the locking plate 22 is the pressure plate 42. This pressure plate 42 is axially movable in this case inside the spring device 06, wherein in the direction of the heat shield element 11 the spring force of the spring element 49 is counteracted and in the opposite direction the travel is limited by the locking plate 22. The pressure plate 42 is in this case designed in the style of a nut with a threaded hole 46, wherein two guide flanges 43 which are oppositely disposed on the circumference extend from a circular disk. The guide flanges 43 engage with a small clearance in the inner guide groves 33 of the inner sleeve 31.

It is easy to see that the spring device 06 can be pre-assembled so that a correspondingly pretensioned spring pack is made available. During the fixing of the receiving sleeve 21 in the support structure 03, it is also obvious how disassembly of the spring element 49, in which the inner sleeve 31 is screwed out of the receiving sleeve 21, is still possible.

For enabling a screwing of the inner sleeve 31 or the abutment plate 32 in the receiving sleeve 21, an engagement means is advantageously made available on the upper side 27 of the inner sleeve 31. Whether this penetrates the abutment plate 32 in the process is unimportant here providing a suitable tool can be attached for installing the abutment plate or the inner sleeve. Radially symmetrically disposed holes or the like for example can be provided as engagement means. For this purpose, the through-hole 36 can also be hexagonally designed.

Figure 5:
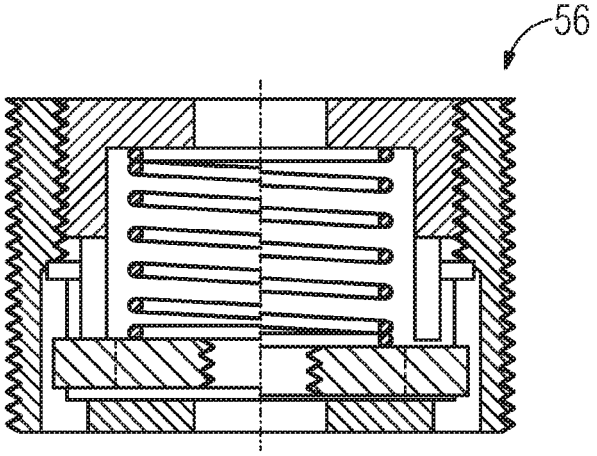
FIG. 5 shows an alternative embodiment for a spring device similar to the view of FIG. 3.
Figure 6:
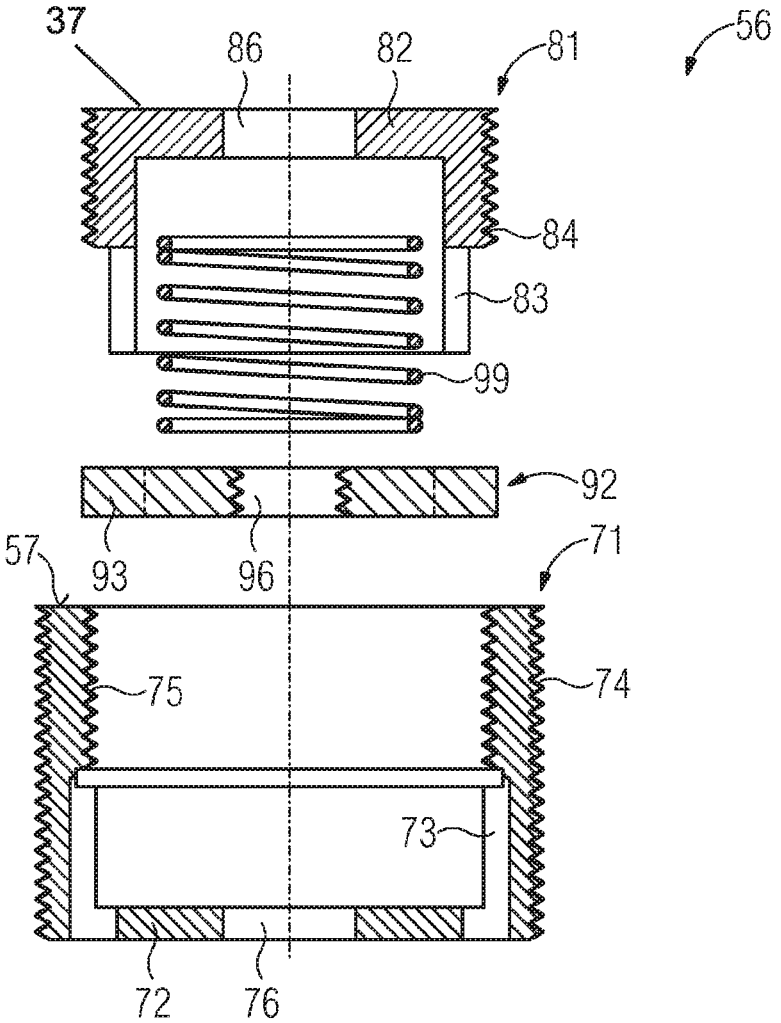
FIG. 6 shows an exploded view in relation to FIG. 5.

Shown in FIGS. 5 and 6 is an alternative exemplary embodiment in which when using the spring device 56 fixing of the inner sleeve 81 relative to the receiving sleeve 71 is particularly advantageously carried out. To this end, the receiving sleeve 71, similar to the previous exemplary embodiment, is first of all constructed and in this respect integrally forms the locking plate 72 which points away from the heat shield element. This locking plate 72 correspondingly also has a through-hole 76. A male thread 74 for screwing into the female thread 05 of the receiving hole 04 of the support structure 03 is also correspondingly located on the outer circumference. In turn, fastening of the inner sleeve 81 in the receiving sleeve 71 by means of a screwed connection is provided so that in a correspondingly similar manner the receiving sleeve 71 has a female thread 75 and the inner sleeve 81 has a male thread 84. The inner sleeve 81 in turn integrally forms the abutment plate 82 with a through-hole 86. The inner sleeve 81 also has two oppositely disposed inner guide grooves 83, wherein in contrast to the previous exemplary embodiment the female thread only extends up to the guide groove 83. The shortening of the thread is not compulsory, but rather it is necessary in this embodiment that the guide groove 83 extends radially through the wall of the inner sleeve 81. Similar to the previous exemplary embodiment, the spring element 99 is again arranged in the inner sleeve 81, which spring element 99 on the side which points toward the heat shield element 11 correspondingly butts against the abutment plate 82 and on the opposite side against a pressure plate 92 the movement of which inside the spring device 56 is limited by the locking plate 72. To this end, the pressure plate 92, corresponding to the previous exemplary embodiment, has a threaded hole 96 for the fitting of the fastening bolt 18.

In contrast to the previous exemplary embodiment, it is now provided, however, that the inner sleeve 81 is shortened by the material thickness of the pressure plate 92 in relation to the depth of the receiving sleeve 71. Furthermore, the receiving sleeve 71 has in each case oppositely disposed outer guide grooves 73 on its lower end, wherein to this end the pressure plate 92 has oppositely disposed extended guide flanges 93. The guide flanges 93, regardless of the presence of the inner sleeve 81, engage in the outer guide grooves 73. In this respect, a rotation of the pressure plate 92 relative to the receiving sleeve 71 independently of the inner sleeve 81 is prevented. On account of the shortened inner sleeve, a rotation of the inner sleeve 81 relative to the receiving sleeve 71 independently of the rotation locking of the pressure plate 91 is possible. If the spring device 56 is subsequently used and by means of the fastening bolt 18 a displacement of the pressure plate 92 against the spring force of the spring element 99 is effected, the inner guide grooves 83 in the inner sleeve 81 lead to a rotation locking of the pressure plate 92 relative to the inner sleeve 81. On account of the already existing rotation locking of the pressure plate 92 relative to the receiving sleeve 71 due to the outer guide grooves 73, a rotation of the inner sleeve 81 relative to the receiving sleeve 71 is provided.

In the case of the advantageous rotation locking, it is in particular not necessary that the upper side 37 of the abutment plate 82 coincides with the upper side 57 of the receiving sleeve 71, i.e. a misalignment is unimportant with regard to this.

The invention claimed is:

1. A heat shield assembly of a combustion chamber, comprising:
- a support structure,
- at least one heat shield element which is arranged on the support structure, which heat shield element comprises a receiving hole, and
- a spring device comprising:
  - a receiving sleeve which is fastened in the support structure;
  - an abutment plate which is fixed in place to a first end of the receiving sleeve proximate the heat shield element during operation;
  - a locking plate is fixed to a second end of the receiving sleeve opposite the first end;
  - a pressure plate which is axially movable along a central axis of the receiving sleeve between the abutment plate and the locking plate;
  - at least one spring element which is arranged between the abutment plate and the pressure plate,
  - a fastening bolt, and
  - an inner sleeve configured to be rotated inside of and fastened inside the receiving sleeve in a removable manner,
- wherein the abutment plate comprises a through-hole and the pressure plate comprises a fastening means, and
- wherein the fastening bolt penetrates the heat shield element via the receiving hole and the abutment plate via the through-hole and engages the fastening means of the pressure plate,
- wherein the abutment plate is fastened in the receiving sleeve in a removable manner.

2. The heat shield assembly as claimed in claim 1,
wherein the locking plate is arranged integrally on the receiving sleeve.

3. The heat shield assembly as claimed in claim 1,
wherein the abutment plate is arranged integrally on the inner sleeve.

4. The heat shield assembly as claimed in claim 1,
wherein at least one of the pressure plate and the at least one spring element is arranged in the inner sleeve.

5. The heat shield assembly as claimed in claim 1,
wherein at least one of the abutment plate and the inner sleeve is screwed in the receiving sleeve.

6. The heat shield assembly as claimed in claim 1, wherein the abutment plate terminates flush with the receiving sleeve.

7. The heat shield assembly as claimed in claim 6, wherein the heat shield element butts against the receiving sleeve and against the abutment plate.

8. The heat shield assembly as claimed in claim 1, wherein the pressure plate comprises a guide flange which engages in at least one of an inner guide groove in the inner sleeve and an outer guide groove in the receiving sleeve.

9. The heat shield assembly as claimed in claim 8, wherein the pressure plate comprises the guide flange which engages in the inner guide groove in the inner sleeve and in the outer guide groove in the receiving sleeve, and wherein the guide flange, upon abutment of the pressure plate against the locking plate, is disengaged from the inner guide groove in the inner sleeve.

10. A combustion chamber comprising:

a heat shield assembly as claimed in claim 1.

11. A gas turbine comprising:

a combustion chamber as claimed in claim 10.

12. The heat shield assembly as claimed in claim 1, wherein the combustion chamber is of a gas turbine.

13. A spring device, comprising:

a receiving sleeve adapted to be fastened in a support structure, an inner sleeve configured to be rotated inside of and fastened inside the receiving sleeve in a removable manner, an abutment plate which is fixed in place at a first end of the receiving sleeve proximate the heat shield during operation, a fixed locking plate at a second end of the receiving sleeve opposite the first end, a pressure plate which is axially movable between the abutment plate and the locking plate along a central axis of the receiving sleeve, and at least one spring element which is arranged between the abutment plate and the pressure plate, wherein the abutment plate comprises a through-hole and the pressure plate comprises a fastening means, wherein the fastening means comprises female threads, a fastening bolt configured to penetrate the abutment plate and engage the fastening means of the pressure plate such that fastening the fastening bolt pulls the pressure plate toward the abutment plate against a bias of the at least one spring element, wherein the abutment plate is fastened in the receiving sleeve in a removable manner.

* * * * *